US009622007B2

(12) United States Patent
Cho et al.

(10) Patent No.: US 9,622,007 B2
(45) Date of Patent: Apr. 11, 2017

(54) METHOD AND APPARATUS FOR REPRODUCING THREE-DIMENSIONAL SOUND

(71) Applicant: SAMSUNG ELECTRONICS CO., LTD., Gyeonggi-do (KR)

(72) Inventors: Yong-choon Cho, Suwon-si (KR); Sun-min Kim, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/817,443

(22) Filed: Aug. 4, 2015

(65) Prior Publication Data

US 2015/0358753 A1 Dec. 10, 2015

Related U.S. Application Data

(63) Continuation of application No. 13/636,089, filed as application No. PCT/KR2011/001849 on Mar. 17, 2011, now Pat. No. 9,113,280.

(60) Provisional application No. 61/315,511, filed on Mar. 19, 2010.

(30) Foreign Application Priority Data

Mar. 15, 2011 (KR) ..... 10-2011-0022886

(51) Int. Cl.

| | |
|---|---|
| ***H04R 5/00*** | (2006.01) |
| ***H04S 1/00*** | (2006.01) |
| ***H04S 7/00*** | (2006.01) |

(52) U.S. Cl.

CPC ..... *H04S 1/002* (2013.01); *H04S 7/00* (2013.01); *H04S 7/40* (2013.01); *H04S 2400/11* (2013.01); *H04S 2420/01* (2013.01)

(58) Field of Classification Search

CPC ..... H04S 1/002; H04S 2420/01

See application file for complete search history.

(56) References Cited

U.S. PATENT DOCUMENTS

| | | | |
|---|---|---|---|
| 5,555,306 | A | 9/1996 | Gerzon |
| 5,768,393 | A | 6/1998 | Mukojima et al. |
| 5,862,229 | A | 1/1999 | Shimizu |
| 6,208,346 | B1 | 3/2001 | Washio et al. |
| 6,504,934 | B1 | 1/2003 | Kasai et al. |

(Continued)

FOREIGN PATENT DOCUMENTS

| | | | |
|---|---|---|---|
| CN | 101350931 | A | 1/2009 |
| JP | 6105400 | A | 4/1994 |

(Continued)

OTHER PUBLICATIONS

Communication dated Aug. 21, 2014 issued by the State Intellectual Property Office of the People's Republic of China in counterpart Chinese Application No. 201180014834.2.

(Continued)

*Primary Examiner* — Brenda Bernardi

(74) *Attorney, Agent, or Firm* — Sughrue Mion, PLLC

(57) ABSTRACT

Stereophonic sound is reproduced by acquiring image depth information indicating a distance between at least one object in an image signal and a reference location, acquiring sound depth information indicating a distance between at least one sound object in a sound signal and a reference location based on the image depth information, and providing sound perspective to the at least one sound object based on the sound depth information.

20 Claims, 6 Drawing Sheets

(56) References Cited

U.S. PATENT DOCUMENTS

| | | | |
|---|---|---|---|
| 6,829,018 | B2 | 12/2004 | Lin et al. |
| 7,027,600 | B1 | 4/2006 | Kaji et al. |
| 7,158,642 | B2 | 1/2007 | Tsuhako |
| 7,801,317 | B2 | 9/2010 | Kim |
| 7,818,077 | B2 | 10/2010 | Bailey |
| 8,705,778 | B2 | 4/2014 | Zhan et al. |
| 2003/0053680 | A1 | 3/2003 | Lin et al. |
| 2006/0050890 | A1 | 3/2006 | Tsuhako |
| 2007/0182865 | A1 | 8/2007 | Lomba et al. |
| 2011/0007915 | A1 | 1/2011 | Park |

FOREIGN PATENT DOCUMENTS

| | | | |
|---|---|---|---|
| JP | 6-269096 | A | 9/1994 |
| JP | 11-220800 | A | 8/1999 |
| JP | 2006-128816 | A | 5/2006 |
| JP | 2009-278381 | A | 11/2009 |
| KR | 1999-0068477 | A | 9/1999 |
| KR | 10-2005-0115801 | A | 12/2005 |
| KR | 10-0688198 | B1 | 3/2007 |
| KR | 1020090031057 | A | 3/2009 |
| KR | 10-0922585 | B1 | 10/2009 |
| KR | 10-0934928 | B1 | 1/2010 |
| RU | 2 145 778 | C1 | 2/2000 |
| RU | 23032 | U1 | 5/2002 |
| RU | 2 232 481 | C1 | 7/2004 |
| RU | 2 251 818 | C2 | 5/2005 |

OTHER PUBLICATIONS

Communication dated Dec. 9, 2013 issued by the Federal Service on Industrial Property on counterpart Russian Application No. 2012140018/08.

Communication dated Jan. 13, 2015 issued by the Japanese Patent Office in counterpart Japanese Patent Application No. 2012-558085.

Communication dated May 2, 2014, issued by the Ministry of Justice and Human Rights of the Republic of Indonesia Directorate General of Intellectual Property Rights in counterpart Indonesian Application No. W-00201204235.

Communication dated Nov. 26, 2014 issued by the European Patent Office in counterpart European Patent Application No. 11756561.4.

Communication dated Sep. 17, 2013 issued by the Australian Patent Office in counterpart Australian Patent Application No. 2011227869.

Communication from the Australian Patent Office issued Feb. 24, 2015 in a counterpart Australian Application No. 2011227869.

Communication from the State Intellectual Property Office of P.R. China dated Feb. 16, 2015 in a counterpart application No. 201180014834.2.

International Search Report (PCT/ISA/210), dated Sep. 28, 2011, issued by the International Searching Authority in counterpart International Application No. PCT/JKR2011/001849.

Written Opinion (PCT/ISA/237) dated Sep. 28, 2011, issued by the International Searching Authority in counterpart International Application No. PCT/KR2011/001849.

Communication dated Nov. 21, 2016, issued by the Korean Intellectual Property Office in counterpart Korean Application No. 10-2011-0022886.

METHOD AND APPARATUS FOR REPRODUCING THREE-DIMENSIONAL SOUND

CROSS-REFERENCE

This application is a continuation of U.S. patent application Ser. No. 13/636,089 filed on Sep. 19, 2012 in the United States Patent and Trademark Office, which is a National Stage Entry of International Application PCT/KR2011/001849 filed on Mar. 17, 2011, which claims the benefit of priority from U.S. Provisional Patent Application 61/315,511 filed on Mar. 19, 2010, and which also claims the benefit of priority from Republic of Korea application 10-2011-0022886 filed on Mar. 15, 2011. The disclosures of all of the foregoing applications are incorporated by reference, herein, in their entireties.

FIELD

Methods and apparatuses consistent with exemplary embodiments relate to reproducing stereophonic sound, and more particularly, to reproducing stereophonic sound to provide sound perspective to a sound object.

BACKGROUND

Three-dimensional (3D) video and image technology is becoming nearly ubiquitous, and this trend shows no sign of ending. A user is made to visually experience a 3D stereoscopic image through an operation that exposes left viewpoint image data to the left eye, and right viewpoint image data to the right eye. The presence of binocular disparity makes it so that a user can perceive or recognize an object that appears to realistically jump out from a viewing screen, or to enter the screen and move away in the distance.

Although there have been many developments in providing a visual 3D experience, audio has also seen many remarkable advances, too. Audiophiles and everyday users are both very interested in a full listening experience that includes sound and, in particular, 3D stereophonic sound. In stereophonic sound technology, a plurality of speakers are placed around a user so that the user may experience sound localization at different locations and thus experience sound in varying sound perspectives. What is needed now, however, is a way to enhance a user's 3D video/image experience with stereophonic sound that is in concert with the action being viewed. In the conventional user experience, though, an image object that is to be perceived as leaping out of the screen so as to approach the user (or is to be perceived as entering the screen so as to become more distant from the user) is not efficiently or effectively matched by a suitable, corresponding, stereophonic audio sound effect.

SUMMARY

Figure 1:
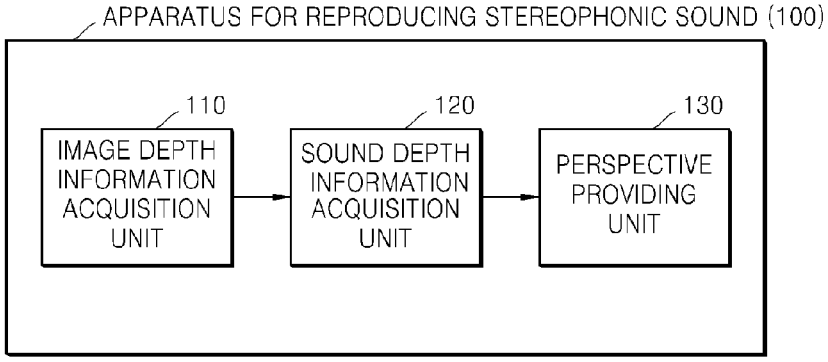
FIG. 1 is a block diagram of an apparatus for reproducing stereophonic sound according to an exemplary embodiment.

Methods and apparatuses consistent with exemplary embodiments provide for efficiently reproducing stereophonic sound and in particular, for reproducing stereophonic sound, which efficiently represent sound that approaches a user or becomes more distant from the user by providing perspective to a sound object.

According to an exemplary embodiment, there is provided a method of reproducing stereophonic sound, the method including acquiring image depth information indicating a distance between at least one image object in an image signal and a reference location; acquiring sound depth information indicating a distance between at least one sound object in a sound signal and a reference location based on the image depth information; and providing sound perspective to the at least one sound object based on the sound depth information.

The acquiring of the sound depth information includes acquiring a maximum depth value for each image section that constitutes the image signal; and acquiring a sound depth value for the at least one sound object based on the maximum depth value.

The acquiring of the sound depth value includes determining the sound depth value as a minimum value when the maximum depth value is within a first threshold value and determining the sound depth value as a maximum value when the maximum depth value exceeds a second threshold value.

The acquiring of the sound depth value further includes determining the sound depth value in proportion to the maximum depth value when the maximum depth value is between the first threshold value and the second threshold value.

The acquiring of the sound depth information includes acquiring location information about the at least one image object in the image signal and location information about the at least one sound object in the sound signal; making a determination as to whether the location of the at least one image object matches with the location of the at least one sound object; and acquiring the sound depth information based on a result of the determination.

The acquiring of the sound depth information includes acquiring an average depth value for each image section that constitutes the image signal; and acquiring a sound depth value for the at least one sound object based on the average depth value.

The acquiring of the sound depth value includes determining the sound depth value as a minimum value when the average depth value is within a third threshold value.

The acquiring of the sound depth value includes determining the sound depth value as a minimum value when a difference between an average depth value in a previous section and an average depth value in a current section is within a fourth threshold value.

The providing of the sound perspective includes controlling a level of power of the sound object based on the sound depth information.

The providing of the sound perspective includes controlling a gain and a delay time of a reflection signal generated so that the sound object can be perceived as being reflected, based on the sound depth information.

The providing of the sound perspective includes controlling a level of intensity of a low-frequency band component of the sound object based on the sound depth information.

The providing of the sound perspective includes controlling a level of difference between a phase of the sound object to be output through a first speaker and a phase of the sound object to be output through a second speaker.

The method further includes outputting the sound object, to which the sound perspective is provided, through at least one of a plurality of speakers including a left surround speaker, a right surround speaker, a left front speaker, and a right front speaker.

The method further includes orienting a phase of the sound object outside of the plurality of speakers.

The acquiring of the sound depth information includes carrying out the providing of the sound perspective at a level based on a size of each of the at least one image object.

The acquiring of the sound depth information includes determining a sound depth value for the at least one sound object based on a distribution of the at least one image object.

According to another exemplary embodiment, there is provided an apparatus for reproducing stereophonic sound, the apparatus including an image depth information acquisition unit for acquiring image depth information indicating a distance between at least one image object in an image signal and a reference location; a sound depth information acquisition unit for acquiring sound depth information indicating a distance between at least one sound object in a sound signal and a reference location based on the image depth information; and a perspective providing unit for providing sound perspective to the at least one sound object based on the sound depth information.

According to still another exemplary embodiment, there is provided a digital computing apparatus, comprising a processor and memory; and a non-transitory computer readable medium comprising instructions that enable the processor to implement a sound depth information acquisition unit; wherein the sound depth information acquisition unit comprises a video-based location acquisition unit which identifies an image object location of an image object; an audio-based location acquisition unit which identifies a sound object location of a sound object; and a matching unit which outputs matching information indicating a match, between the image object and the sound object, when a difference between the image object location and the sound object location is within a threshold.

DETAILED DESCRIPTION

Hereinafter, one or more exemplary embodiments will be described with reference to the accompanying drawings. One or more exemplary embodiments may overcome the above-mentioned disadvantage and other disadvantages not described above. However, it is understood that one or more exemplary embodiment are not required to overcome the disadvantages described above, and may not overcome any of the problems described above.

Firstly, for convenience of description, a few terms used herein are briefly defined as follows.

An "image object" denotes an object included in an image signal or a subject such as a person, an animal, a plant and the like. It is an object to be visually perceived.

A "sound object" denotes a sound component included in a sound signal. Various sound objects may be included in one sound signal. For example, in a sound signal generated by recording an orchestra performance, various sound objects generated from various musical instruments such as guitar, violin, oboe, and the like are included. Sound objects are to be audibly perceived.

A "sound source" is an object (for example, a musical instrument or vocal band) that generates a sound object. Both an object that actually generates a sound object and an object that recognizes that a user generates a sound object denote a sound source. For example, when an apple (or other object such as an arrow or a bullet) is visually perceived as moving rapidly from the screen toward the user while the user watches a movie, a sound (sound object) generated when the apple is moving may be included in a sound signal. The sound object may be obtained by recording a sound actually generated when an apple is thrown (or an arrow is shot) or may be a previously recorded sound object that is simply reproduced. However, in either case, a user recognizes that an apple generates the sound object and thus the apple may be a sound source as defined in this specification.

"Image depth information" indicates a distance between a background and a reference location and a distance between an object and a reference location. The reference location may be a surface of a display device from which an image is output.

"Sound depth information" indicates a distance between a sound object and a reference location. More specifically, the sound depth information indicates a distance between a location (a location of a sound source) where a sound object is generated and a reference location.

As described above, when an apple is depicted as moving toward a user, from a screen, while the user watches a movie, the distance between the sound source (i.e., the apple) and the user becomes small. In order to effectively represent to the user that the apple is approaching him or her, it may be represented that the location, from which the sound of the sound object that corresponds to the image object is generated, is also getting closer to the user, and information about this is included in the sound depth information. The reference location may vary according to the location of the sound source, the location of a speaker, the location of the user, and the like.

Sound perspective a sensation that a user experiences with regard to a sound object. A user views a sound object so that the user may recognize the location from where the sound object is generated, that is, a location of a sound source that generates the sound object. Here, a sense of distance, between the user and the sound source that is recognized by the user, denotes the sound perspective.

FIG. 1 is a block diagram of an apparatus 100 for reproducing stereophonic sound according to an exemplary embodiment.

The apparatus 100 for reproducing stereophonic sound according to the current exemplary embodiment includes an image depth information acquisition unit 110, a sound depth information acquisition unit 120, and a perspective providing unit 130.

The image depth information acquisition unit 110 acquires image depth information. Image depth information indicates the distance between at least one image object in an image signal and a reference location. The image depth information may be a depth map indicating depth values of pixels that constitute an image object or background.

The sound depth information acquisition unit 120 acquires sound depth information. Sound depth information indicates the distance between a sound object and a reference location, and is based on the image depth information. There are various methods of generating the sound depth information using the image depth information. Below, two approaches to generating the sound depth information will be described. However, the present invention is not limited thereto.

For example, the sound depth information acquisition unit 120 may acquire sound depth values for each sound object. The sound depth information acquisition unit 120 acquires location information about image objects and location information about the sound object and matches the image objects with the sound objects based on the location information. This matching of sound and image objects may be thought of as matching information. Then, based on the image depth information and the matching information, the sound depth information may be generated. Such an example will be described in detail with reference to FIG. 2.

As another example, the sound depth information acquisition unit 120 may acquire sound depth values according to sound sections that constitute a sound signal. The sound signal includes at least one sound section. Here, a sound signal in one section may have the same sound depth value. That is, in each different sound object, the same sound depth value may be applied. The sound depth information acquisition unit 120 acquires image depth values for each image section that constitutes an image signal. The image section may be obtained by dividing an image signal into frame units or into scene units. The sound depth information acquisition unit 120 acquires a representative depth value (for example, a maximum depth value, a minimum depth value, or an average depth value) in each image section and determines the sound depth value, in the sound section that corresponds to the image section, by using the representative depth value. Such an example will be described in detail with reference to FIG. 3.

The perspective providing unit 130 processes a sound signal so that a user may sense or experience a sound perspective based on the sound depth information. The perspective providing unit 130 may provide the sound perspective according to each sound object after the sound objects corresponding to image objects are extracted, provide the sound perspective according to each channel included in a sound signal, or provide the sound perspective for all sound signals.

The perspective providing unit 130 performs at least one of the following four tasks i), ii), iii) and iv) in order to shape the sound so that the user may effectively sense a sound perspective. However, the four tasks performed in the perspective providing unit 130 are only an example, and the present invention is not limited thereto.

i) The perspective providing unit 130 adjusts the power of a sound object based on the sound depth information. The closer to a user the sound object is generated, the more the power of the sound object increases.

ii) The perspective providing unit 130 adjusts the gain and delay time of a reflection signal based the sound depth information. A user hears both a direct sound signal that is not reflected by any obstacle and a reflection sound signal reflected by an obstacle. The reflection sound signal has a smaller intensity than that of the direct sound signal, and generally approaches a user by being delayed in comparison to the direct sound signal. In particular, when a sound object is to be generated so as to be perceived as being close to the user, the reflection sound signal arrives later than the direct sound signal, and has a remarkably reduced intensity.

iii) The perspective providing unit 130 adjusts the low-frequency band component of a sound object based on sound depth information. That is to say, a user may remarkably recognize the low-frequency band component in sounds perceived as being close by. Therefore, when the sound object is to be generated so as to be perceived as being close to the user, the low-frequency band component may be boosted.

iv) The perspective providing unit 130 adjusts a phase of a sound object based on sound depth information. As a difference between a phase of a sound object to be output from a first speaker and a phase of a sound object to be output from a second speaker increases, a user recognizes that the sound object is closer.

Various operations of the perspective providing unit 130 will be described in detail later, with reference to FIG. 5.

Figure 2:
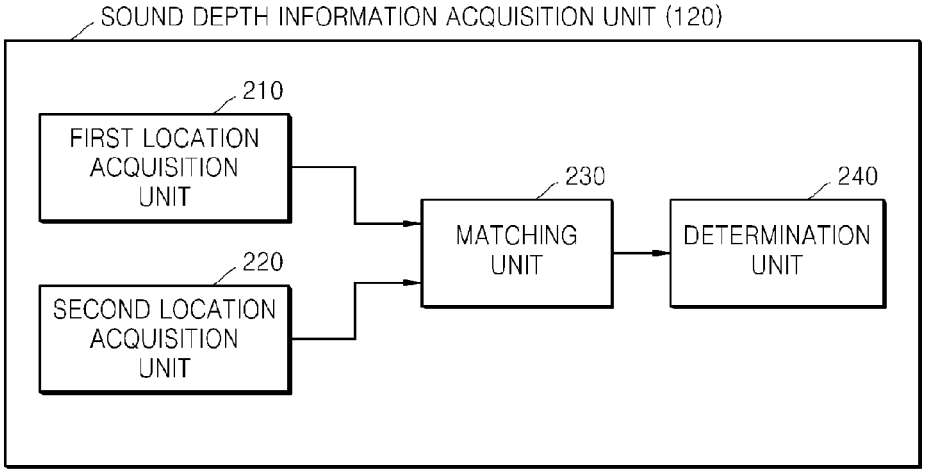
FIG. 2 is a block diagram of a sound depth information acquisition unit of FIG. 1 according to an exemplary embodiment.

FIG. 2 is a block diagram of the sound depth information acquisition unit 120 of FIG. 1 according to an exemplary embodiment.

The sound depth information acquisition unit 120 includes a first location acquisition unit 210, a second location acquisition unit 220, a matching unit 230, and a determination unit 240.

The first location acquisition unit 210 acquires location information of an image object based on the image depth information. The first location acquisition unit 210 may optionally acquire location information only about an image object that moves laterally, or only about an image object that moves forward or backward, etc.

The first location acquisition unit 210 compares depth maps about successive image frames based on Equation 1 below and identifies coordinates in which a change in depth values increases. This is not to say that the depth necessarily increases, but that a change in depth values increases, i.e., the location of an image object is changing.

$$\mathrm{Diff}_{x,y}^{i}=I_{x,y}^{i}=I_{x,y}^{i}-_{x,y}^{i+1} \quad \text{[Equation 1]}$$

In Equation 1, i indicates the frame number and x,y indicates coordinates. Accordingly, $I^{i}_{x,y}$ indicates a depth value of the $i^{th}$ frame at the coordinates of (x,y).

The first location acquisition unit 210 searches for coordinates where $\mathrm{Diff}^{i}_{x,y}$ is above a threshold value, after $\mathrm{Diff}^{i}_{x,y}$ is calculated for all coordinates. The first location acquisition unit 210 determines an image object that corresponds to the coordinates, where $\mathrm{Diff}^{i}_{x,y}$ is above a threshold value, as an image object whose movement is sensed. The corresponding coordinates are determined to be the location of the image object.

The second location acquisition unit 220 acquires location information about a sound object, based on a sound signal. There are various methods of acquiring the location information about the sound object by the second location acquisition unit 220.

As an example, the second location acquisition unit 220 separates a primary component and an ambience component from a sound signal, compares the primary component with the ambience component, and thereby acquires the location information about the sound object. Also, the second location acquisition unit 220 compares powers of each channel of a sound signal, and thereby acquires the location information about the sound object. In this method, left and right locations of the sound object may be optionally be separately identified.

As another example, the second location acquisition unit 220 divides a sound signal into a plurality of sections, calculates the power of each frequency band in each section, and determines a common frequency band based on the power calculated for each frequency band. In this approach, the common frequency band denotes a common frequency band in which power is above a predetermined threshold value in adjacent sections. For example, frequency bands having power of greater than 'A' are selected in a current section, and frequency bands having power of greater than 'A' are selected in a previous section (or frequency bands having power of within high fifth rank in a current section is selected in a current section and frequency bands having power of within high fifth rank in a previous section is selected in a previous section). Then, the frequency band that is commonly selected in the previous section and the current section is determined to be the common frequency band.

Limiting the selection of the frequency bands to only those above a threshold value is done to acquire a location of a sound object that has a large signal intensity. Accordingly, the influence of a sound object that has a small signal intensity is minimized, and the influence of a main sound object may be maximized. By determining whether there is a common frequency band, it can be determined whether a new sound object that did not exist in a previous section exists in a current section. It can also be determined whether a characteristic (for example, a generation location) of a sound object, that existed in the previous section, is changed.

When the location of an image object is changed in a depth direction of a display device, the power of a sound object, that corresponds to the image object, is also changed. In this case, the power of a frequency band, that corresponds to the sound object, is changed and so the location of the sound object in the depth direction may be identified by examining the change of power in each frequency band.

The matching unit 230 determines the relationship between an image object and a sound object, based on the location information about the image object and the location information about the sound object. The matching unit 230 determines that the image object matches with the sound object when a difference between coordinates of the image object and coordinates of the sound object is less than a threshold value. On the other hand, the matching unit 230 determines that the image object does not match with the sound object when a difference between coordinates of the image object and coordinates of the sound object are above a threshold value The determination unit 240 determines a sound depth value for the sound object, based on the determination by the matching unit 230, which may be thought of as a matching determination. For example, for a sound object that has been determined as matching with an image object, a sound depth value is determined according to a depth value of the image object. In a sound object that is determined not to match with an image object, a sound depth value is determined as a minimum value. When the sound depth value is determined as a minimum value, the perspective providing unit 130 does not provide sound perspective to the sound object.

Even though the locations of the image object and the sound object may match, the determination unit 240 may, in predetermined exceptional circumstances, not provide sound perspective to the sound object.

For example, when the size of an image object is below a threshold value, the determination unit 240 may not provide a sound perspective to the sound object that corresponds to the image object. Since an image object having a very small size only slightly affects a user's 3D effect experience, the determination unit 240 may optionally not provide any sound perspective to the corresponding sound object.

Figure 3:
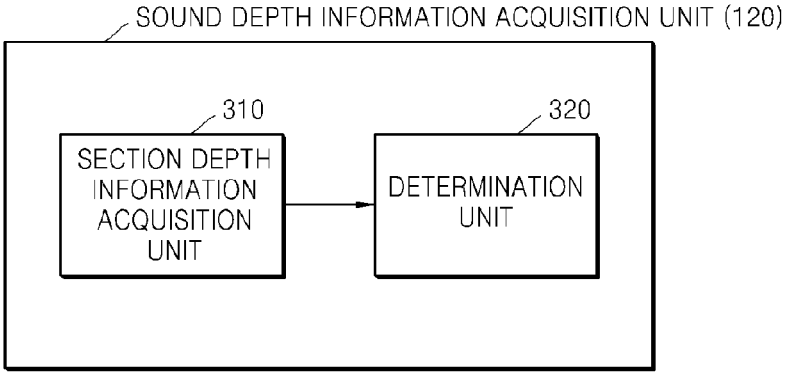
FIG. 3 is a block diagram of a sound depth information acquisition unit of FIG. 1 according to another exemplary embodiment.

FIG. 3 is a block diagram of the sound depth information acquisition unit 120 of FIG. 1 according to another exemplary embodiment.

The sound depth information acquisition unit 120 according to the current exemplary embodiment includes a section depth information acquisition unit 310 and a determination unit 320.

The section depth information acquisition unit 310 acquires depth information for each image section based on image depth information. An image signal may be divided into a plurality of sections. For example, the image signal may be divided into scene units, in which a scene is converted, by image frame units, or GOP units.

The section depth information acquisition unit 310 acquires image depth values corresponding to each section. The section depth information acquisition unit 310 may acquire image depth values corresponding to each section based on Equation 2, below.

$$\text{Depth}^i = E\left(\sum_{x,y} I^i_{x,y}\right) \quad \text{[Equation 2]}$$

In Equation 2, $I^i_{x,y}$ indicates a depth value of an $i^{th}$ frame at (x,y) coordinates. $\text{Depth}^i$ is an image depth value corresponding to the $i^{th}$ frame and is obtained by averaging the depth values of all pixels in the $i^{th}$ frame.

Equation 2 is only an example, and the representative depth value of a section may be determined by the maximum depth value, the minimum depth value, or a depth value of a pixel in which a change from a previous section is remarkably large.

The determination unit 320 determines a sound depth value, for a sound section that corresponds to an image section, based on the representative depth value of each section. The determination unit 320 determines the sound depth value according to a predetermined function to which the representative depth value of each section is input. The determination unit 320 may use a function, in which an input value and an output value are constantly proportional to each other, and a function, in which an output value exponentially increases according to an input value, as the predetermined function. In another exemplary embodiment, functions that differ from each other according to a range of input values may be used as the predetermined function. Examples of the predetermined function used by the determination unit 320 to determine the sound depth value will be described later with reference to FIG. 4.

When the determination unit 320 determines that sound perspective does not need to be provided to a sound section, the sound depth value in the corresponding sound section may be determined as a minimum value.

The determination unit 320 may acquire a difference in depth values between an $i^{th}$ image frame and an $i+1^{th}$ image frame that are adjacent to each other according to Equation 3 below.

$$\text{Diff_Depth}^i = \text{Depth}^i - \text{Depth}^{i+1} \quad \text{[Equation 3]}$$

Here, $Diff_Depth^i$ indicates a difference between an average image depth value in the $i^{th}$ frame and an average image depth value in the $i+1^{th}$ frame.

The determination unit 320 determines whether to provide sound perspective, to a sound section that corresponds to an $i^{th}$ frame, according to Equation 4 below.

$$R_Flag^i = \begin{cases} 0, & \text{if } Diff_Depth^i \geq th \\ 1, & \text{else} \end{cases} \quad \text{[Equation 4]}$$

The $R_Flag^i$ is a flag indicating whether to provide sound perspective to a sound section that corresponds to the $i^{th}$ frame. When $R_Flag^i$ has a value of 0, sound perspective is provided to the corresponding sound section but when $R_Flag^i$ has a value of 1, sound perspective is not provided to the corresponding sound section.

When the average inter-frame difference, i.e., between an average image depth value in a previous frame and an average image depth value in the next frame, is large, it may be determined that there is a high probability of the existence of an image object that is about to jump out of a screen. Accordingly, the determination unit 320 may determine that sound perspective will be provided to a sound section that corresponds to an image frame only when $Diff_Depth^i$ is above a threshold value th.

The determination unit 320 determines whether to provide sound perspective, to a sound section that corresponds to an $i^{th}$ frame, according to Equation 5 below.

$$R_Flag^i = \begin{cases} 0, & \text{if } Depth^i \geq th \\ 1, & \text{else} \end{cases} \quad \text{[Equation 5]}$$

In this example, $R_Flag^i$ is a flag indicating whether to provide sound perspective to a sound section that corresponds to the $i^{th}$ frame. When $R_Flag^i$ has a value of 0, sound perspective is provided to the corresponding sound section, but when $R_Flag^i$ has a value of 1, sound perspective is not provided to the corresponding sound section.

Even when there is a large difference between the average image depth value in a previous frame and an average image depth value in the next frame is large, if the average image depth value in the next frame is below a threshold value, then there is a high probability that the next frame does not include an image object that appears to jump out from the screen. Accordingly, the determination unit 320 may determine that sound perspective is provided to a sound section that corresponds to an image frame only when $Depth^i$ is above a threshold value (for example, 28 in FIG. 4).

Figure 4:
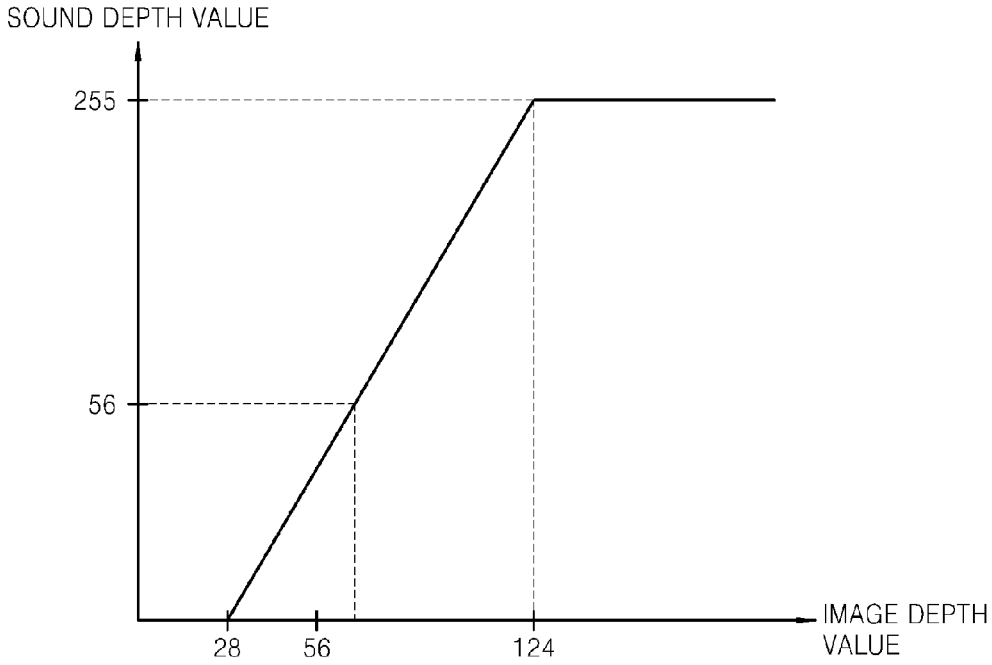
FIG. 4 is a graph illustrating a predetermined function used to determine a sound depth value in determination units according to an exemplary embodiment.

FIG. 4 is a graph illustrating a predetermined function used to determine a sound depth value in determination units 240 and 320 according to an exemplary embodiment.

In the predetermined function illustrated in FIG. 4, the horizontal axis indicates image depth and the vertical axis indicates sound depth. The image depth value may have a value in the range of 0 to 255.

In this exemplary embodiment, an image depth value greater or equal to 0 and less than 28 corresponds to a sound depth value that is the minimum value. When the sound depth value is the minimum value, no sound perspective is provided.

When the image depth value is greater or equal to 28 and less than 124, an amount of change in the sound depth value according to an amount of change in the image depth value is constant (that is, the slope is constant). According to other exemplary embodiments, the slope is not linear, but may change exponentially or logarithmically.

In another embodiment, when the image depth value is greater or equal to 28 and less than 56, a fixed sound depth value (for example, 58), by which a user may hear natural stereophonic sound, may be determined as a sound depth value.

When the image depth value is greater or equal to 124, the sound depth value is set as a maximum value. According to an exemplary embodiment, to simplify calculation, the maximum value of the sound depth value may be regulated and used.

Figure 5:
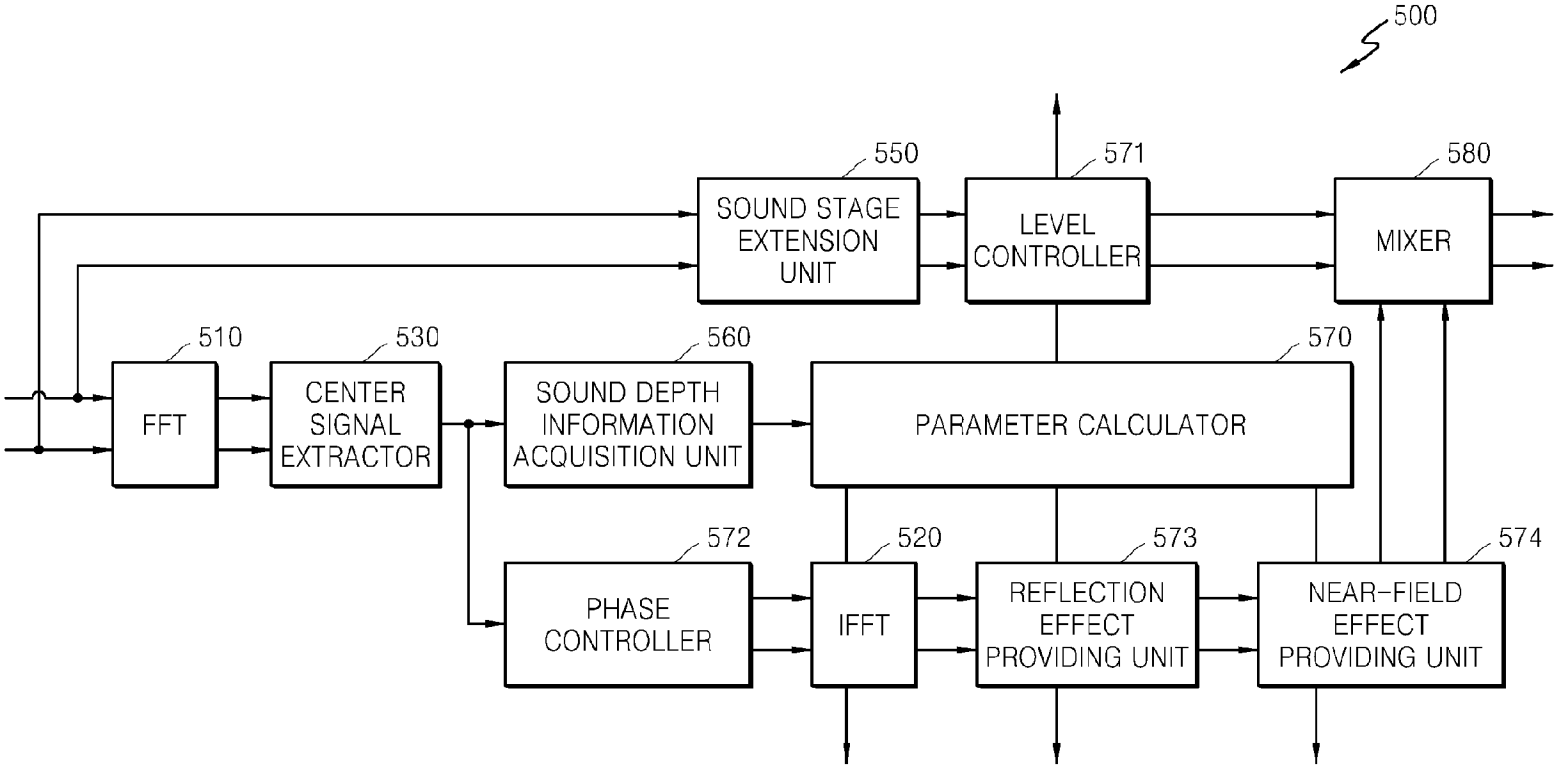
FIG. 5 is a block diagram of a perspective providing unit that provides stereophonic sound using a stereo sound signal according to an exemplary embodiment.

FIG. 5 is a block diagram of perspective providing unit 500 corresponding to the perspective providing unit 130 that provides stereophonic sound using a stereo sound signal according to an exemplary embodiment.

When an input signal is a multi-channel sound signal, the present invention may be applied after down mixing the input signal to a stereo signal.

A fast Fourier transformer (FFT) 510 performs fast Fourier transformation on the input signal.

An inverse fast Fourier transformer (IFFT) 520 performs inverse-Fourier transformation on the Fourier transformed signal.

A center signal extractor 530 extracts a center signal, which is a signal corresponding to a center channel, from a stereo signal. The center signal extractor 530 extracts a signal having a high correlation, in the stereo signal, as a center channel signal. In FIG. 5, it is assumed that sound perspective is to be provided to the center channel signal. However, sound perspective may be provided to other channel signals, which are not the center channel signals, such as one of the left and right front channel signals, one of the left right surround channel signals, a specific sound object, or an entire sound signal.

A sound stage extension unit 550 extends a sound stage. The sound stage extension unit 550 orients a sound stage beyond a speaker by artificially providing appropriate time or phase differences to the stereo signal.

The sound depth information acquisition unit 560 acquires sound depth information, based on the image depth information.

A parameter calculator 570 determines a control parameter value needed to provide sound perspective to a sound object, based on sound depth information.

A level controller 571 controls the intensity of an input signal.

A phase controller 572 controls the phase of the input signal.

A reflection effect providing unit 573 models the generation of a reflected signal, simulating the way that an input signal can reflected by a wall or other obstacle.

A near-field effect providing unit 574 models a sound signal generated near to a user.

A mixer 580 mixes at least one signal and outputs the mixed signal to a speaker or speaker system.

Hereinafter, the operation of a perspective providing unit 500, for reproducing stereophonic sound, will be described in a generally chronological manner.

Firstly, when a multi-channel sound signal is input, the multi-channel sound signal is converted into a stereo signal through a downmixer (not illustrated).

The FFT 510 performs fast Fourier transformation on the stereo signals and then outputs the transformed signals to the center signal extractor 530.

The center signal extractor 530 compares the transformed stereo signals with each other, and outputs a center channel signal (i.e., a signal determined based on a high correlation between the stereo signals).

The sound depth information acquisition unit 560 acquires sound depth information based on image depth information. Acquisition of the sound depth information by the sound depth information acquisition unit 560 has been described, above, with reference to FIGS. 2 and 3. More specifically, the sound depth information acquisition unit 560 compares the location of a sound object with the location of an image object, thereby acquiring the sound depth information, or it uses the depth information of each section of an image signal, thereby acquiring the sound depth information.

The parameter calculator 570 calculates parameters to be applied to the modules that are used to provide the sound perspective, based on index values.

The phase controller 572 reproduces two signals from a center channel signal, and controls the phases of at least one of the two reproduced signals in accordance with parameters calculated by the parameter calculator 570. When a sound signal that has signals of two different phases is reproduced through a left speaker and a right speaker, a blurring phenomenon results. When the blurring phenomenon intensifies, it is hard for a user to accurately recognize a location from which a sound object is generated. In this regard, when a method of controlling the signal phase is used, along with at least one other method of providing perspective, the resulting effect may be maximized.

As the location where a sound object is generated gets closer to a user (or when the location rapidly approaches the user), the phase controller 572 sets the phase difference of the two reproduced signals to be larger. The thus-reproduced signals are transmitted to the reflection effect providing unit 573 through the IFFT 520.

The reflection effect providing unit 573 models a reflection signal. When a sound object is generated at a location distant from a user, direct sound that is directly transmitted to a user without being reflected from a wall is similar to the reflection sound, and the difference in the time of arrival of the direct sound and the reflection sound is imperceptible. However, when a sound object is generated so as to be perceived as near a user, the intensities of the direct sound and reflection sound are different from each other and the time difference in arrival of the direct sound and the reflection sound is larger. Accordingly, as the sound object is generated near the user, the reflection effect providing unit 573 markedly reduces the gain of the reflection signal, increases the arrival delay time, or relatively increases the intensity of the direct sound. The reflection effect providing unit 573 transmits the center channel signal, in which the reflection signal is considered, to the near-field effect providing unit 574.

The near-field effect providing unit 574 models the sound object generated near the user based on parameters calculated in the parameter calculator 570. When the sound object is generated near the user, a low band component is increased. The near-field effect providing unit 574 increases the low band component of the center signal the closer the location where the sound object is generated is to the user.

The sound stage extension unit 550, which receives the stereo input signal, processes the stereo signal so that the sound phase is oriented outside of a speaker. When the speaker locations are sufficiently far from each other, the user may perceive the stereophonic sound to be realistic.

The sound stage extension unit 550 converts a stereo signal into a widening stereo signal. The sound stage extension unit 550 may include a widening filter, which convolutes left/right binaural synthesis with a crosstalk canceller, and one panorama filter, which convolutes a widening filter and a left/right direct filter. Here, the widening filter constitutes the stereo signal by a virtual sound source for an arbitrary location based on a head related transfer function (HRTF) measured at a predetermined location, and cancels the crosstalk of the virtual sound source based on a filter coefficient, to which the HRTF is reflected. The left/right direct filter controls a signal characteristic, such as a gain and delay, between an original stereo signal and the crosstalk-cancelled virtual sound source.

The level controller 571 controls the power intensity of a sound object based on the sound depth value calculated in the parameter calculator 570. As the sound object is generated closer to a user, the level controller 571 may increase the perceived size of the sound object.

The mixer 580 mixes the stereo signal transmitted from the level controller 571 with the center signal transmitted from the near-field effect providing unit 574, and outputs the mixed signal to a speaker.

Figure 6:
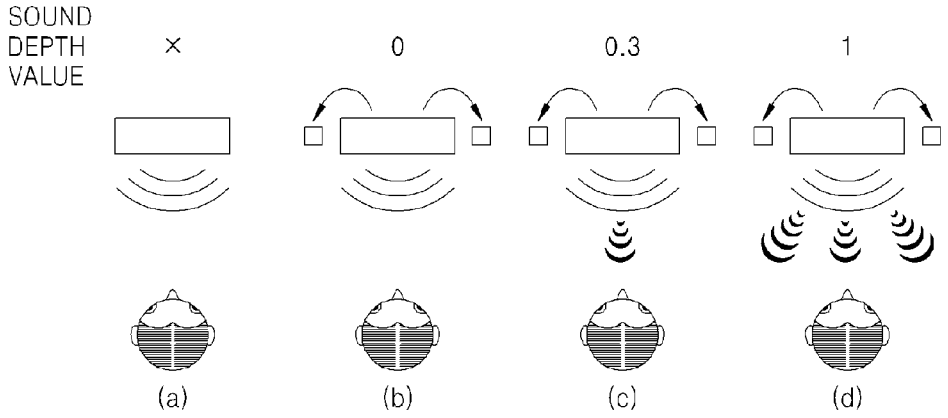
FIG. 6 illustrates providing of stereophonic sound in the apparatus for reproducing stereophonic sound of FIG. 1 according to an exemplary embodiment.

FIG. 6 illustrates the providing of stereophonic sound in the apparatus 100 according to an exemplary embodiment.

In (a) of FIG. 6, no stereophonic sound object is provided.

A user hears the sound object through at least one speaker. When a user hears a reproduced mono signal from just one speaker, the user will typically not experience any stereoscopic sensation, but when the user hears a stereo signal reproduced by using at least two speakers, the user may experience a stereoscopic sensation.

In (b) of FIG. 6, a sound object having a sound depth value of '0' is reproduced. In FIG. 4, it is assumed that the sound depth value is '0' to '1.' If the sound object is represented as being generated near the user, the sound depth value is increased.

Since the sound depth value of the sound object is '0,' no sound perspective is added to the sound object. However, since the sound phase is oriented to the outside of the speaker, the user may experience a stereoscopic sensation through the stereo signal. According to exemplary embodiments, technology whereby a sound phase is oriented outside of a speaker is referred to as 'widening' technology.

In general, sound signals of a plurality of channels are required in order to reproduce a stereo signal. Accordingly, when a mono signal is input, sound signals corresponding to at least two channels are generated through upmixing.

In the stereo signal, the sound signal of a first channel is reproduced through a left speaker and the sound signal of a second channel is reproduced through a right speaker. A user may experience a stereoscopic sensation by hearing at least two sound signals generated from the different locations.

However, when the left speaker and the right speaker are too close to each other, the user might perceive the sound is generated from just one location, and thus not experience a stereoscopic sensation. In this case, the sound signal is processed so that the user may perceive that the sound is generated outside of the speaker, instead of by the actual speaker.

In (c) of FIG. 6, a sound object having a sound depth value of '0.3' is reproduced.

Since the sound depth value of the sound object is greater than 0, a sound perspective corresponding to the sound depth value of '0.3' is provided to the sound object, together with the provision of widening technology. Accordingly, the user may perceive that the sound object generated is nearer the user when compared with (b) of FIG. 6.

For example, assume that a user views 3D image data, and that an image object being shown is represented as jumping out from the screen. In (c) of FIG. 6, sound perspective is provided to the sound object that corresponds to an image object, so that the sound object changes as it approaches the user. The user visibly senses that the image object jumps out of the screen and the user has the sensation that the sound object also approaches the user, thereby more realistically experiencing a stereoscopic sensation.

In (d) of FIG. 6, a sound object having a sound depth value of '1' is reproduced.

Since the sound depth value of the sound object is greater than 0, a sound perspective corresponding to the sound depth value of '1' is provided to the sound object, together with the provision of widening technology. Since the sound depth value of the sound object in (d) of FIG. 6 is greater than that of the sound object in (c) of FIG. 6, a user perceives that the sound object generated is even closer to the user than in (c) of FIG. 6.

Figure 7:
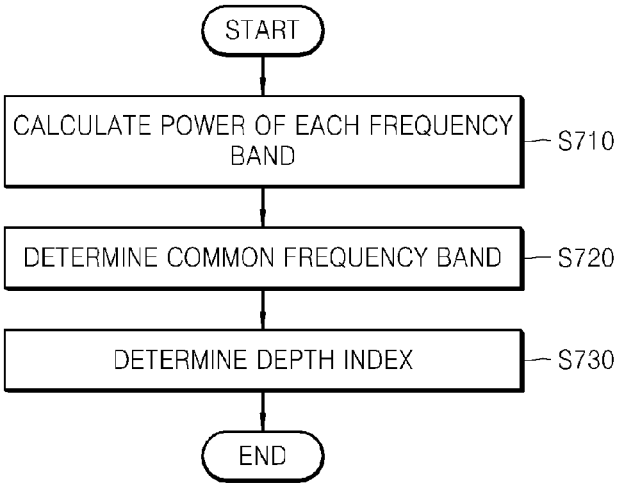
FIG. 7 is a flowchart illustrating a method of detecting a location of a sound object based on a sound signal according to an exemplary embodiment.

FIG. 7 is a flowchart illustrating a method of detecting a location of a sound object based on a sound signal according to an exemplary embodiment.

In operation S710, the power of each frequency band is calculated for each of a plurality of sections that constitute a sound signal.

In operation S720, a common frequency band is determined based on the power of each frequency band.

The common frequency band denotes a frequency band in which power in previous sections and power in a current section are all above a predetermined threshold value. Here, the frequency band having low power may correspond to a meaningless sound object such as noise. Thus, the frequency band that has low power may be excluded from the common frequency band. For example, after a predetermined number of frequency bands are sequentially selected according to the highest power, the common frequency band may be determined from the selected frequency band.

In operation S730, power of the common frequency band in the previous sections is compared with power of the common frequency band in the current section. A sound depth value is determined based on a result of the comparison. When the power of the common frequency band in the current section is greater than the power of the common frequency band in the previous sections, it is determined that the sound object corresponding to the common frequency band is generated closer to the user. Also, when the power of the common frequency band in the previous sections is similar to the power of the common frequency band in the current section, it is determined that the sound object does not closely approach the user.

Figure 8:
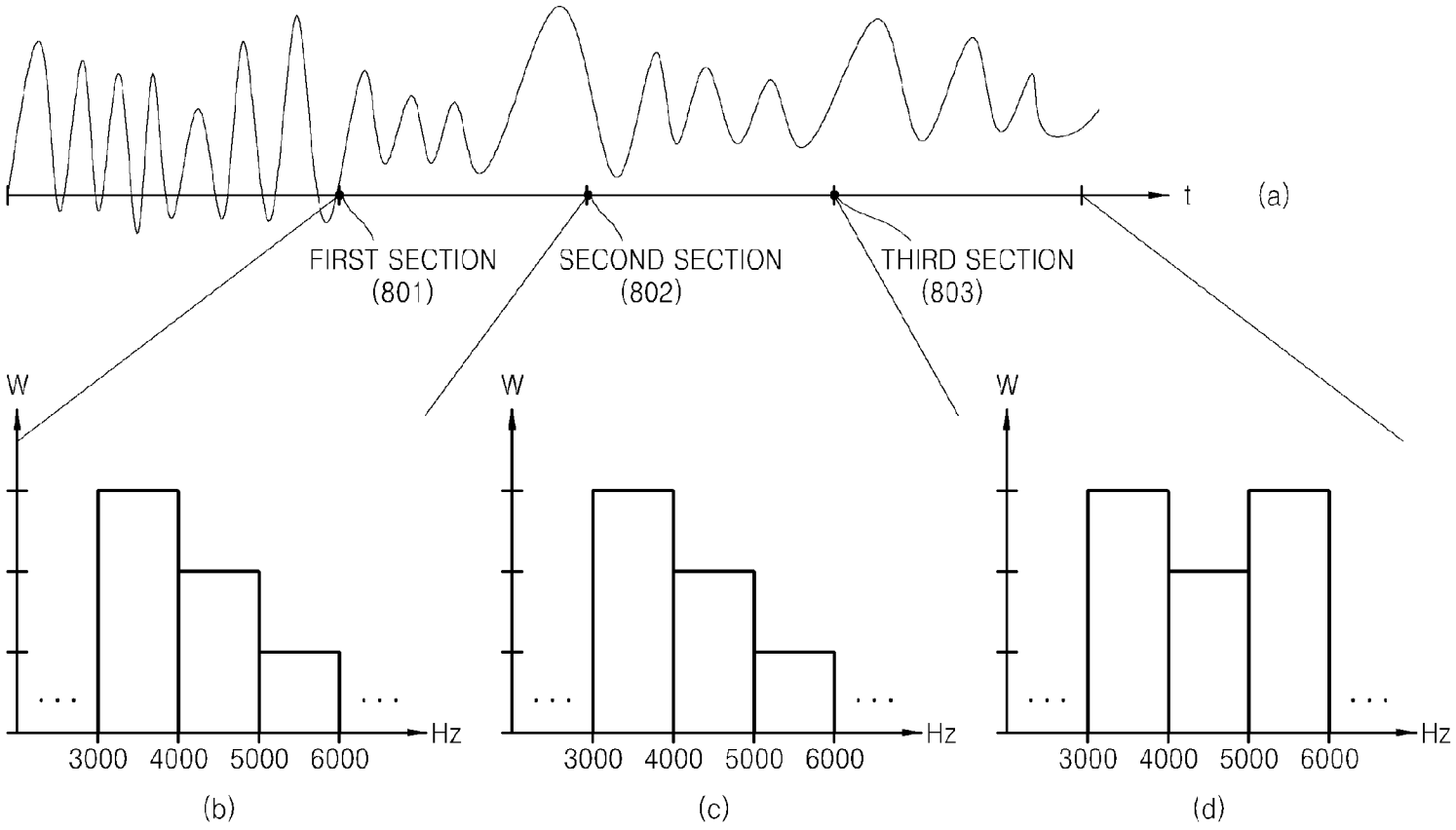
FIG. 8 illustrates detection of a location of a sound object from a sound signal according to an exemplary embodiment.

FIG. 8 illustrates detection of a location of a sound object from a sound signal according to an exemplary embodiment.

In (a) of FIG. 8, a sound signal divided into a plurality of sections is illustrated along a time axis.

In (b) through (d) of FIG. 8, the power of each frequency band in the first, second, and third sections (801, 802, and 803) are illustrated. In (b) through (d) of FIG. 8, the first and second sections 801 and 802 are previous sections and the third section 803 is a current section.

Referring to (b) and (c) of FIG. 8, when it is assumed that powers of frequency bands of 3000 to 4000 Hz, 4000 to 5000 Hz, and 5000 to 6000 Hz are above a threshold value in the first through third sections, the frequency bands of 3000 to 4000 Hz, 4000 to 5000 Hz, and 5000 to 6000 Hz are determined as the common frequency band.

Referring to (c) and (d) of FIG. 8, the powers of the frequency bands of 3000 to 4000 Hz and 4000 to 5000 Hz in the second section 802 are similar to powers of the frequency bands of 3000 to 4000 Hz and 4000 to 5000 Hz in the third section 803. Accordingly, a sound depth value of a sound object that corresponds to the frequency bands of 3000 to 4000 Hz and 4000 to 5000 Hz is determined as '0.'

However, the power of the frequency band of 5000 to 6000 Hz in the third section 803 is markedly increased in comparison to the power of the frequency band of 5000 to 6000 Hz in the second section 802. Accordingly, the sound depth value of a sound object that corresponds to the frequency band of 5000 to 6000 Hz is determined as '0.' According to exemplary embodiments, an image depth map may be referred to in order to accurately determine a sound depth value of a sound object.

For example, the power of the frequency band of 5000 to 6000 Hz in the third section 803 is markedly increased compared with power of the frequency band of 5000 to 6000 Hz in the second section 802. In some cases, a location, where the sound object that corresponds to the frequency band of 5000 to 6000 Hz is generated, is not close to the user. Instead, only the power is increased at the same location. Here, when it is determined that an image object that protrudes from a screen exists in an image frame that corresponds to the third section 803 with reference to the image depth map, there may be a high probability that the sound object that corresponds to the frequency band of 5000 to 6000 Hz corresponds to the image object. In this case, it may be preferable that a location where the sound object is generated gets gradually closer to the user and thus the sound depth value of the sound object is set to '0' or greater. When the image object that protrudes from a screen does not exist in an image frame that corresponds to the third section 803, only the power of the sound object increases at the same location and thus a sound depth value of the sound object may be set to '0.'

Figure 9:
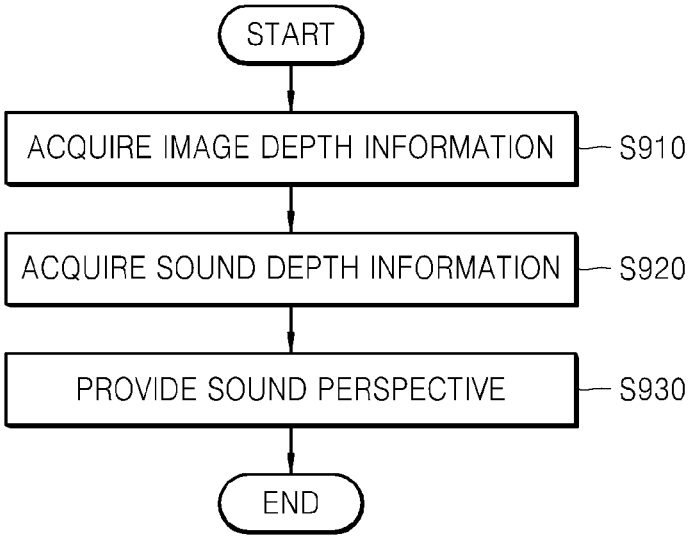
FIG. 9 is a flowchart illustrating a method of reproducing stereophonic sound according to an exemplary embodiment.

FIG. 9 is a flowchart illustrating a method of reproducing stereophonic sound according to an exemplary embodiment.

In operation S910, the image depth information (i.e., visual information) is acquired. The image depth information indicates a distance between at least one image object and a location in a stereoscopic image signal used as a visual reference point.

In operation S920, the sound depth information (i.e., audio information) is acquired. The sound depth information indicates the distance between at least one sound object in a sound signal and an audio reference point.

In operation S930, sound perspective is provided to the at least one sound object based on the sound depth information.

The exemplary embodiments can be concretely implemented as computer code, and can be implemented in general-use digital computers that have a memory and a processor to execute the programs referring to a computer readable recording medium.

Examples of a computer readable recording medium include non-transitory computer readable media such as magnetic storage media (e.g., ROM, floppy disks, hard disks, etc.), or optical recording media (e.g., CD-ROMs, or DVDs). Another type of computer readable media include transitory media such as carrier waves (e.g., transmission through the Internet).

While the inventive concept has been particularly shown and described with reference to exemplary embodiments thereof, it will be understood by those of ordinary skill in the art that various changes in form and detail may be made without departing from the spirit and scope of the following claims.

The invention claimed is:

1. A method of reproducing perspective sound, the method comprising:

obtaining image depth information indicating a distance between at least one image object and a reference position, wherein the reference position is a user position;

obtaining image scene information indicating a characteristic of an image section;

acquiring sound depth information indicating a distance between at least one sound object and the reference position, based on the image depth information and the image scene information; and providing sound perspective to the at least one sound object based on the sound depth information.

2. The method of claim 1, wherein the acquiring of the sound depth information comprises:

acquiring a maximum depth value for the image section; and acquiring a sound depth value for the at least one sound object based on the acquired maximum depth value.

3. The method of claim 2, wherein the acquiring of the sound depth value comprises:

determining the sound depth value as a minimum value when the acquired maximum depth value is within a first threshold value; and determining the sound depth value as a maximum value when the maximum depth value exceeds a second threshold value.

4. The method of claim 3, wherein the acquiring of the sound depth value further comprises determining the sound depth value in proportion to the maximum depth value when the acquired maximum depth value is between the first threshold value and the second threshold value.

5. The method of claim 1, wherein the acquiring of the sound depth information comprises:

acquiring location information about the at least one image object and location information about the at least one sound object;

determining making a determination as to whether a difference between the location of the at least one image object and the location of the at least one sound object is within a threshold; and acquiring the sound depth information based on a result of the determination.

6. The method of claim 1, wherein the acquiring of the sound depth information comprises:

acquiring an average depth value for the image section; and acquiring a sound depth value for the at least one sound object based on the acquired average depth value.

7. The method of claim 6, wherein the acquiring of the sound depth value comprises determining the sound depth value as a minimum value when the acquired average depth value is within a third threshold value.

8. The method of claim 6, wherein the acquiring of the sound depth value comprises determining the sound depth value as a minimum value when a difference between an average depth value in a previous one of the plurality of sections and an average depth value in a current one of the plurality of sections is less than a fourth threshold value.

9. The method of claim 1, wherein the providing of the sound perspective comprises controlling a level of power of the sound object, based on the sound depth information.

10. The method of claim 1, wherein the providing of the sound perspective comprises controlling a gain and a delay time of a reflection signal generated so that the sound object can be perceived as being reflected, based on the sound depth information.

11. The method of claim 1, wherein the providing of the sound perspective comprises controlling a level of intensity of a low-frequency band component of the sound object, based on the sound depth information.

12. The method of claim 1, wherein the providing of the sound perspective comprises controlling a level of difference between a phase of the sound object to be output through a first speaker and a phase of the sound object to be output through a second speaker.

13. The method of claim 1, further comprising outputting the sound object, to which the sound perspective is provided, through at least one of a plurality of speakers including a left surround speaker, a right surround speaker, a left front speaker, and a right front speaker.

14. The method of claim 13, further comprising orienting a phase of the sound object outside of one of the plurality of speakers.

15. The method of claim 1, wherein the providing of the sound perspective is carried out at a level based on a size of each of the at least one image object.

16. The method of claim 1, wherein the acquiring of the sound depth information comprises determining a sound depth value for the at least one sound object based on a distribution of the at least one image object.

17. An apparatus for reproducing perspective sound, the apparatus comprising:

an image depth information acquisition unit for obtaining image depth information indicating a distance between at least one image object and a reference position and obtaining image scene information indicating a characteristic of an image section, wherein the reference position is a user position;

a sound depth information acquisition unit for acquiring sound depth information indicating a distance between at least one sound object and the reference position, based on the image depth information and the image scene information; and a perspective providing unit for providing sound perspective to the at least one sound object based on the sound depth information.

18. The apparatus of claim 17, wherein;

the sound depth information acquisition unit acquires a maximum depth value for the image section; and the sound depth information acquisition unit acquires a sound depth value for the at least one sound object based on the acquired maximum depth value.

19. The apparatus of claim 18, wherein:

the sound depth information acquisition unit determines the sound depth value as a minimum value when the acquired maximum depth value is within a first threshold value; and the sound depth information acquisition unit determines the sound depth value as a maximum value when the maximum depth value exceeds a second threshold value.

20. The apparatus of claim 18, wherein the sound depth value is determined in proportion to the maximum depth value when the acquired maximum depth value is between the first threshold value and the second threshold value.

* * * * *